United States Patent [19]

Ferris et al.

[11] 4,262,443

[45] Apr. 21, 1981

[54] POP-UP WHALE

[75] Inventors: Michael J. Ferris, Chicago; Palmer J. Schoenfield, Evanston; Burton C. Meyer, Downers Grove, all of Ill.

[73] Assignee: Marvin Glass & Associates, Chicago, Ill.

[21] Appl. No.: 119,886

[22] Filed: Feb. 8, 1980

[51] Int. Cl.[3] ..... A63H 11/10

[52] U.S. Cl. ..... 46/103; 46/204

[58] Field of Search ..... 46/103, 204, 145, 97, 46/98; 273/322, 324; 124/16, 26

[56] References Cited

U.S. PATENT DOCUMENTS

| | | | |
|---|---|---|---|
| 2,590,467 | 3/1952 | Sacks | 46/204 |
| 2,651,881 | 9/1953 | Glass et al. | 46/145 X |
| 3,059,929 | 10/1962 | Licitis | 273/322 |
| 3,197,918 | 8/1965 | Coggeshall | 46/141 X |
| 3,959,922 | 6/1976 | Leistikow | 46/141 X |
| 4,031,659 | 6/1977 | Keller et al. | 46/141 X |

*Primary Examiner*—Gene Mancene
*Assistant Examiner*—Mickey Yu
*Attorney, Agent, or Firm*—Mason, Kolehmainen, Rathburn & Wyss

[57] ABSTRACT

A toy vehicle is disclosed including a vehicle body or housing including a front projectile receiving channel and a separate top projectile exit channel. The housing includes a wheel actuated impeller for carrying the projectile from the front projectile receiving channel to the top projectile exit channel. An impeller stop member is provided to temporarily stop the flexible impeller to bias the impeller until sufficient biasing force is accumulated in the impeller to snap the impeller beyond the stop member and strike the projectile with the snapping force of the impeller to propel the projectile out of the projectile exit channel and thereby out of the toy vehicle.

4 Claims, 5 Drawing Figures

POP-UP WHALE

BACKGROUND OF THE INVENTION

Field of the Invention

The present invention relates to a figure toy capable of lifting a projectile from a floor or other surface and propelling the projectile upwardly out of the body of the toy. More particularly, the present invention relates to a toy whale movable on wheels along a surface and capable of scooping up a ball from that surface and propelling the ball upwardly out of the top of the whale to simulate the natural spouting action of a real whale.

OBJECTS OF THE PRESENT INVENTION

An object of the present invention is to provide a figure toy capable of receiving a ball or other projectile as the figure toy rolls along a surface on wheels to overlie the ball or projectile and impel the ball or projectile through a channel disposed within a housing of the figure toy by snapping the ball or projectile upwardly through the channel with a spring biased mechanical impeller.

Another object of the present invention is to provide a wheeled toy vehicle having a projectile receiving channel adapted to receive a projectile as the vehicle travels along a surface on its wheels and including means for lifting the projectile to a projectile shooting station and including means for shooting the projectile out of the vehicle.

Another object of the present invention is to provide a toy vehicle having a shape of an animal or mammal and having a projectile receiving channel disposed at a front end of the vehicle so that the vehicle can be aimed so as to receive the projectile as the vehicle rolls along a surface on its wheels and including projectile shooting means actuated by wheel rotation so that rotation of the wheels by moving the vehicle along the surface will propel the projectile out of the vehicle through a separate projectile exit channel.

Another object of the present invention is to provide a toy projectile receiving and launching device including a projectile impeller for capturing a projectile within the housing of the toy and providing a sudden impact force from the impeller to the projectile to propel the projectile through the toy housing and out of the toy.

In brief, the above and other objects and advantages of the present invention are accomplished by providing a toy vehicle in any given design or shape including a vehicle body or housing including a front projectile receiving channel and a separate top projectile exit channel and a wheel actuated impeller for carrying the projectile from the front projectile receiving channel to the top projectile exit channel and including an impeller stop member to temporarily stop a flexible impeller to bias the impeller until sufficient biasing force is accumulated in the impeller to snap the impeller beyond the stop member and strike the projectile with the snapping force of the impeller to propel the projectile out of the projectile exit channel and thereby out of the vehicle.

DETAILED DESCRIPTION OF A PREFERRED EMBODIMENT

Figure 1:
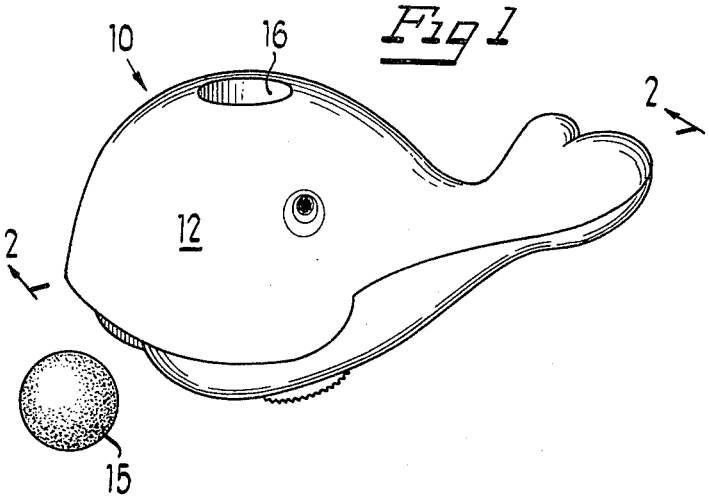
FIG. 1 is a perspective view of the toy vehicle manufactured in accordance with the principles of the present invention.
Figure 5:
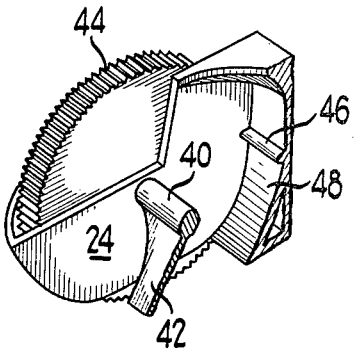
FIG. 5 is a perspective view of a front wheel and wheel housing portion of the toy vehicle of the present invention.
Figure 2:
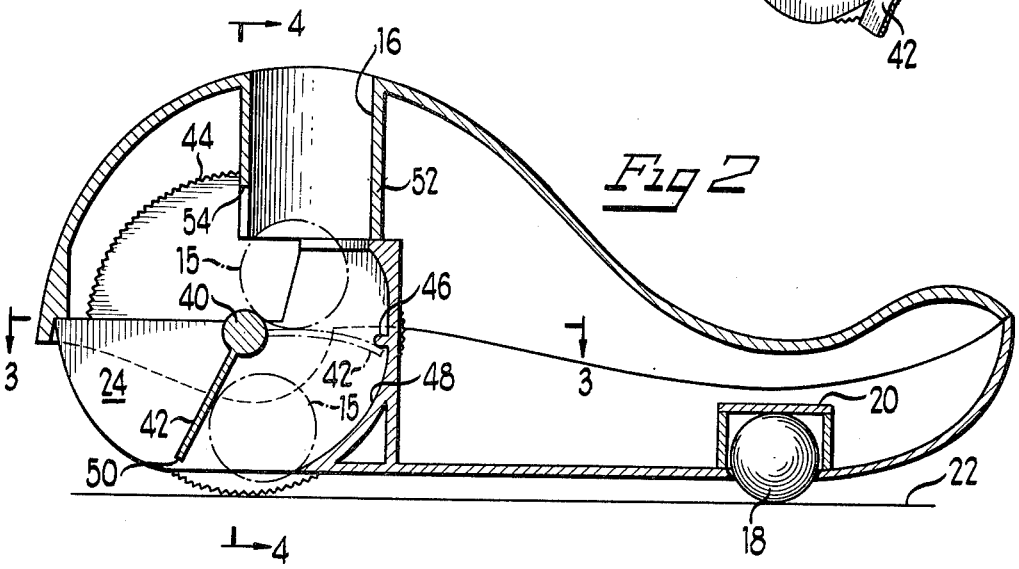
FIG. 2 is a cross-sectional view of the toy vehicle of the present invention taken through the line 2—2 of FIG. 1 showing in solid lines the impeller receiving a projectile and lifting the projectile from the front projectile receiving channel to the top projectile exit channel and showing the impeller in broken lines temporarily stopped by an impeller stop member whereby the impeller is spring biased just prior to the impeller striking the undersurface of the porjectile to propel it out of the projectile exit channel of the toy vehicle of the present invention.

Turning now to the drawing, there is illustrated a toy vehicle manufactured in accordance with the principles of the present invention and generally designated by reference numeral 10. This particular toy vehicle is in the general shape of a whale but it is understood that various other designs or simulations of other creatures, vehicles and the like can also be used. The toy vehicle 10 of the present invention generally includes a vehicle body or housing 12 in a desired design which includes a front projectile receiving channel 14 for receiving a projectile 15 and a top projectile exit channel 16 for directing a propelled projectile out of the toy vehicle 10. The toy vehicle 10 also includes a spherical rear wheel 18 rotatably secured within a rear wheel housing 20 for moving a rear portion of the toy vehicle 10 in any given direction along a surface 22 (FIG. 2). It is most desirable to provide a spherical rear wheel 18 on the toy vehicle 10 of the present invention so that the rear end of the toy vehicle can be rotated in any given direction along surface 22.

Figure 3:
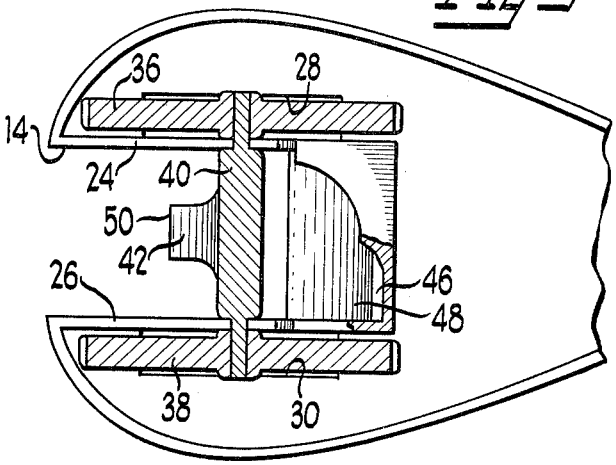
FIG. 3 is a partially broken away cross-sectional top view taken through the line 3—3 of FIG. 2 showing the front projectile receiving channel of the toy vehicle of the present invention.

The front projectile receiving channel 14, as best shown in FIG. 3, is defined by two generally parallel interior upstanding housing walls 24 and 26. The housing walls 24 and 26 have elongated apertures 28 and 30, respectively, where interior housing walls 24 and 26 meet exterior housing walls 32 and 34, respectively, to permit two large front wheels 36 and 38 to protrude through the bottom of the vehicle housing 12 for unobstructed contact against floor surface 22. The front wheels 36 and 38 are disposed adjacent to the front projectile receiving channel 14 and within the vehicle housing 12 so that the front wheels 36 and 38 do not interfer with receiving a projectile 15 in the front projectile receiving channel 14. The large front wheels 36 and 38 are interconnected through central axle 40 and central axle 40 includes an impeller 42 as an integral part thereof of secured thereto so that impeller 42 rotates with the wheels 36 and 38 and the axle 40.

The wheels 36 and 38 support the housing 12 above the travel surface 22, as shown in FIG. 2 and includes serrations or ridges 44 to provide gripping or non-slipping contact against surface 22 so that enough torque can be imparted to impeller 42 to enable the impeller 42 to flex sufficiently to escape an impeller stop member 46. The impeller stop member is disposed on curved rear channel wall 48 which connects projectile receiving channel 14 to projectile exit channel 16 so that the impeller imparts a sudden propelling snapping force to an undersurface of the projectile 15. The projectile 15 rests on the impeller 42 as a free end 50 of impeller 42 is temporarily prevented from further rotational movement as the impeller 42 flexes against stop member 46. Further rotation of wheels 36 and 38 against contact surface 22 enable the flexible impeller, i.e., made from a plastic material such as ployethylene or polypropylene, to suddenly slip past stop member 46 to snap against the undersurface of projectile 15 to propel the projectile upwardly through projectile exit channel 16.

Figure 4:
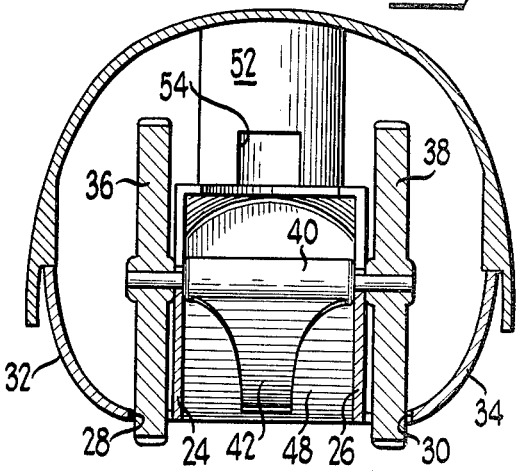
FIG. 4 is a cross-sectional front view of the toy vehicle of the present invention taken through the line 4—4 of FIG. 3.

The projectile 15 rests on an upper surface of impeller 42 as impeller 42 becomes spring biased against stop member 46 and the projectile is prevented from falling back into the front projectile receiving channel 14 by front annular channel wall 52, of exit channel 16, as shown in FIGS. 2 and 4. The front exit channel wall 52 includes a rectangular aperture 54, FIG. 4, to permit the impeller to continue its rotational movement about axle 40 after propelling projectile 15 upwardly through exit channel 16. The free end 50 of impeller 15, therefore, is less wide than the diameter of projectile 15 to permit the impeller 42 but not the projectile 15 to proceed through aperture 54.

Generally, the wheels 36 and 38 will be rotated by rolling the toy 10 along a generally flat surface 22 as shown in FIG. 2. However, the toy 10 can be otherwise actuated, for example in water, by inserting the projectile 15 within the front projectile receiving channel 14 and rotating the wheels 36 and 38 by hand to propel the projectile 15 out of projectile exit channel 16 to simulate a real whale so that the toy 10 can be used as a bathtub toy.

Although the present invention has been described with reference to a single illustrative embodiment thereof, it will be apparent that various changes and modifications thereof will occur to those skilled in the art. It is intended in the appended claims to cover all such changes and modifications as fall within the true spirit and scope of the present invention.

What is claimed and desired to be secured by Letters Patent of the United States is:

1. A toy vehicle adapted to simulate a geysering expulsion of water by a whale, comprising:

a generally enclosed housing generally in the shape of a whale having an upper side and a lower side, said lower side having a projectile receiving aperture and said upper side having a projectile expelling aperture;

at least three wheels rotatably extending out from said lower side of said housing;

a flexible impeller operatively connected for rotation by one of said wheels;

a projectile receiving channel disposed within said housing communicating with said projectile receiving aperture and adapted to receive a projectile when said channel overlies said projectile;

a projectile launching channel extending generally vertically within said housing in communication with said projectile expelling aperture;

a projectile launching station disposed within said housing and communicating with both said receiving and said launching channels, said impeller rotatably mounted within said station to convey a projectile from said receiving channel to said launching channel; and means within said station located along the path of rotation of said impeller for flexing said impeller to propel said projectile by spring action through said launching channel and out said projectile expelling aperture upwardly over said housing.

2. The toy of claim 1 wherein said impeller has a width substantially less than the width of said projectile launching station, said impeller mounted for rotation along an axis extending generally parallel to the width of said impeller, through said launching channel, said launching channel being slotted to allow said impeller to pass while preventing the passage of said projectile and insuring that said projectile passes outwardly through said launching channel.

3. A toy vehicle as defined in claim 1 wherein said projectile receiving channel is defined by upstanding interior housing walls having an open area between bottom surfaces of said upstanding walls such that said housing is adapted to overlie a projectile while said projectile is unsupported by said toy vehicle.

4. A toy as defined in claim 1 wherein said means for spring biasing said impeller comprises a stop means disposed under said projectile launching channel for temporarily preventing further movement of a free end of said impeller until said impeller flexes sufficiently to escape said stop means whereby said impeller imparts a sudden propelling snapping force to an undersurface of said projectile to propel said projectile through said projectile launching channel and out of said housing.

* * * * *